United States Patent [19]

Branson

[11] 4,297,809

[45] Nov. 3, 1981

[54] CHIRPING FLYING SAUCER

[76] Inventor: Charles R. Branson, P.O. Box 216, Seahurst, Wash. 98062

[21] Appl. No.: 105,519

[22] Filed: Dec. 20, 1979

[51] Int. Cl.[3] ..... A63H 27/00

[52] U.S. Cl. ..... 46/74 D; 46/175 R

[58] Field of Search ..... 46/74 D, 75, 52; 273/424, 425; 46/175 R, 177

[56] References Cited

U.S. PATENT DOCUMENTS

| | | | |
|---|---|---|---|
| 3,900,986 | 8/1975 | Torres | 46/74 D |
| 3,900,987 | 8/1975 | Holt | 46/74 D |
| 3,959,916 | 6/1976 | Meyer | 46/74 D |
| 4,031,655 | 6/1977 | Poncian et al. | 46/74 D |

*Primary Examiner*—Gene Mancene
*Assistant Examiner*—Mickey Yu
*Attorney, Agent, or Firm*—David L. Garrison

[57] ABSTRACT

A saucer shaped flying toy has imbedded therein a chirp producing whistle device which operates when the toy is thrown and spun in either direction. The whistle has a raised portion with an elongated sharp-edged opening. The raised portion extends into the airstream passing over the toy to provide turbulent air flow past the whistle opening.

4 Claims, 5 Drawing Figures

CHIRPING FLYING SAUCER

BACKGROUND OF THE INVENTION

1. Field of the invention:

This invention relates, in general, to aerodynamically-shaped flying toys and, in particular, to saucer shaped flying toys having a sound emitting whistle means on the surface thereof, said whistle means generating an intermittent sound when the toy is tossed through the air and spun in either direction about its axis at sufficient combined angular and translational velocity.

2. Description of the Prior Art:

Saucer-shaped flying toys have become very popular in the last several decades. One such family of saucers is marketed by the Wham-O Manufacturing Company of San Gabriel, California under the registered trademark FRISBEE. U.S. Pat. No. 3,359,678 issued to Edward E. Headrick and assigned to the Wham-O Manufacturing Company describes the aerodynamic principles of one saucer toy of this type. The usual embodiment of a saucer shaped flying toy is made of a plastic material and has a central portion with a depending rim located at the edge of the central portion. The rim has a thickness somewhat greater than the central portion. The rim curves downwardly from the central portion and has a configuration such that the saucer when viewed in elevation approximates the shape of an airfoil.

A wide variety of throwing games use a flying saucer shaped toy as an integral element. The toy is gripped by placing the thumb on the convex side of the toy and one or more fingers on the concave side thereof. The toy is thrown with a snap of the wrist which imparts a spinning motion to the toy upon release from a thrower's hand.

The aerodynamics of saucer shaped flying devices are not well known, but it is believed that the flight of hand propelled saucer shaped toys can be analyzed in terms of certain factors controlled to a substantial extent by a thrower. These factors include spin, forward motion, attitude, direction and force. Spinning the toy imparts gyroscopic motion to the toy which stabilizes the toy throughout its flight. The aerodynamic factors controlled by the user all influence lift and as a consequence, the flight characteristics of the toy. Saucer shaped toys have been compared to an airplane wing moving through the atmosphere. The upper airfoil surface of the wing generates a reduced pressure area to create most of the lift forces acting on the wing. A lesser amount of lift is provided by an area of increased pressure on the lower side of the wing. It is believed that a saucer shaped flying toy behaves in an analogous manner. The center of lift of a flying disk is very near its center of gravity so that a spinning disk maintains stability during flight, aided by the gyroscopic effects imparted by spin. Two other factors obviously under user control are the direction of flight and the amount of translational and rotational force imparted to a saucer shaped flying toy. Factors beyond the immediate control of a user include wind force and the design of the toy itself. *Science Digest,* June, 1978, at pages 73–75, discusses aerodynamics of the FRISBEE.

With regard to design, the Headrick U.S. Pat. No. 3,359,678 provides a means located on the convex side of a saucer shaped flying toy for interrupting the laminar flow of air. Air flows over a smooth aerodynamic surface in a laminar flow regime which provides a smooth decrease in the velocity of air as the surface is approached. At a distance from the surface the air has a freestream velocity, while at the surface the relative velocity is zero. The zone near the surface in which the air velocity is significantly slowed is called the boundary layer. The resultant frictional drag force of the airstream reduces the airstream momentum and slows the wing. The means for interrupting, or spoiling, the smooth flow of air provided by the Headrick U.S. Pat. No. 3,359,678 is a series of concentric ridges, positioned on the convex surface of the toy. Under certain flight conditions, a turbulent boundary layer over the convex side of the saucer results, with corresponding reduction of drag and increased lift.

Various types of sound generating devices on the saucer shaped flying toys and similar articles are known in the prior art. The Holt U.S. Pat. No. 3,900,987 discloses a dome-shaped body having a number of whistles on the outer periphery thereof. The whistle design disclosed is such that the whistles can operate only in one direction of rotation. Each whistle has an air inlet opening partially facing the one operative direction of rotation of the dome-shaped body. An air scoop surrounds each air inlet. This device will not emit a whistle sound if it is spun in an opposite direction. For example, a right-handed toss would activate the whistle while a left-handed toss would not activate the whistle. The air scoop also unduly restricts rotational velocity, detracting from performance and may prevent the velocity necessary to activate the whistle.

The Meyer U.S. Pat. No. 3,959,916 discloses another type of saucer shaped flying toy which has a vibrating reed contained inside a passageway formed in the rim of the toy. The passageway openings are flush with the rim surface. It is believed that the laminar flow along the surface of the rim prevents activation of the sound generating mechanism.

SUMMARY OF THE INVENTION

Accordingly, an object of this invention is to provide a chirping saucer shaped flying toy which operates in either direction of spin about its axis.

Another object of the invention is to provide a saucer shaped flying toy having means thereon to produce a chirping sound during flight.

Another object of this invention is to provide a sound emitting saucer shaped flying toy which is simple to produce in a single major molding step with the final completed device formed by insertion of a flat disc forming one wall of the whistle chamber.

Another object of this invention is to provide a saucer shaped flying toy having a raised portion with a whistle opening therein, which raised portion extends into the airstream to disrupt laminar airflow near the opening thereby enhancing turbulant airflow over said opening.

Briefly, the invention is a saucer shaped flying toy designed to be sailed through the air and simultaneously spun, or rotated, about an axis of rotation. To enhance user enjoyment of the toy, one or more pneumatically-operated whistle devices are provided which are intermittently operative in either direction of spin so that both right-handed and left-handed throws produce a chirping sound in flight. The whistle utilized herein includes a whistle chamber having an orificed portion extending from the convex surface of the toy into the air stream outside the air-toy interface. Not only does the position of the whistle orifice avoid the effects of the laminar flow regime adjacent to the toy surface, but the structure of the whistle device itself may act to interrupt the laminar flow regime and cause turbulence adjacent the toy surface. It is believed that turbulent air flow past the orifice is required to operate the whistle. The orifice has a sharp edge forming at least a part of the perimeter of the orifice and is aligned so that the whistle operates when the toy is rotated in either direction about its axis of rotation. The translational and rotational air velocities past the orifice reinforce each other at certain points of rotation to intensify the whistle sound, producing a chirp-like whistle sound repeated once during each revolution of the spinning toy. A plurality of whistle means may be provided to give multiple "chirps" for each revolution and to provide a plurality of sound frequencies.

The toy is designed to be sailed through the air by a user grasping the toy at its rim in one hand and tossing the toy with forward arm motion and a wrist-snap to impart a spinning, or rotational, motion as well as translational motion to the toy. The toy is formed from a circular central disk portion and a downwardly depending rim positioned concentrically about the central disk. A curved transition portion is positioned between the central disk and the rim. When sailed through the air, the upper surfaces of the central disk and the transition portion as well as the outer surface of the rim contact the air at an interface normaly having substantially laminar air flow adjacent the toy surface. The whistle chamber extending from the toy surface, and other surface modifications, may act to disrupt the laminar flow regime and cause turbulence, thereby enhancing both the flight characteristics of the toy and its sound generating capabilities. A plurality of whistle devices may be spaced symmetrically about the toy, preferably adjacent or projecting outwardly from the rim, or a single whistle device similarly positioned may be successfully employed in this invention. When a plurality of whistle devices are used there may be differing sound generation characteristics used for each device, thereby providing several "chirps" at different musical pitches for each revolution.

DESCRIPTION OF THE PREFERRED EMBODIMENT

Figure 1:
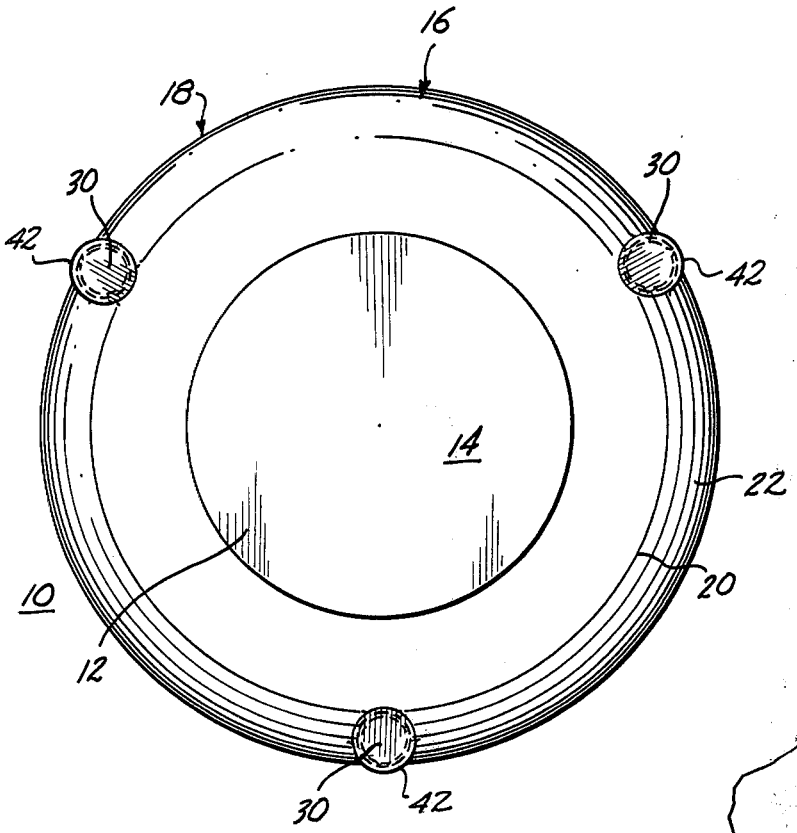
FIG. 1 is a plan view of a saucer shaped flying toy according to the invention.
Figure 2:
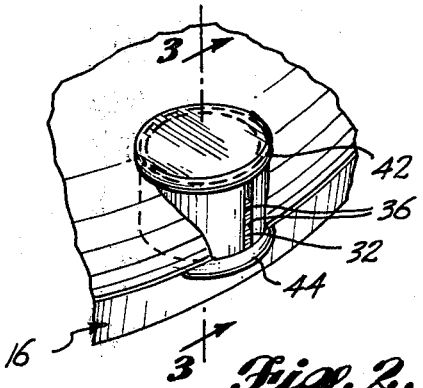
FIG. 2 is an enlarged perspective view of a whistle means provided according to the invention.

Referring to FIGS. 1 and 2 of the drawings, a saucer shaped flying toy 10 according to the present invention is shown. The toy 10 is, for example, molded from a suitable plastic material such as polyethylene. The toy 10 includes a circular central disk 12 having an upper surface 14. A downwardly depending rim 16 is positioned concentrically about the central disk 12 and has an outer surface 18. A transition portion having a convex upper surface 22 provides a smooth transition between the upper surface 14 of the central disk 12 and the outer surface 18 of the rim 16. When flying through the air the smooth outer surface of the toy 10 has substantially laminar flow in a boundary layer of air adjacent to the surface. The axis of rotation of toy 10 is substantially perpendicular to the central disk 12 and is located approximately at the center thereof.

Three whistle devices 30 are shown symmetrically located about the axis of rotation of the toy 10, as shown in FIG. 1. A single whistle device 30 may be used. When two or more whistle devices 30 are used, they are preferably symmetrically positioned on the disk 10. Whistle devices having various pitch levels may provide a variety of musically related sounds.

Figure 3:
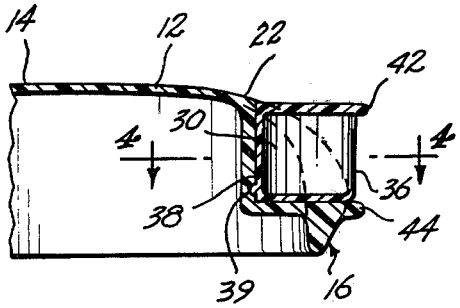
FIG. 3 is a sectional view of a portion of a flying toy taken along section line 3—3 of FIG. 1.

FIGS. 2 and 3 show one embodiment of a saucer shaped flying toy having a snap-in type whistle device 30 which is pneumatically-operated in either direction of rotation of the toy 10 about its axis of rotation. The whistle device 30 is a substantially cylindrical-shaped hollow body having an axis shown aligned substantially parallel to the axis of rotation of the toy 10. A sharp edged orifice 32 communicates with the whistle chamber of the whistle device 30. Orifice 32 is positioned so that the whistle device 30 operates when the toy is rotated in either direction about its axis of rotation. The whistle device 30 of this embodiment is molded of a suitable plastic material separately from the saucer shaped flying top 10. The whistle device 30 is adapted to snap into the position shown with a projecting ridge on the whistle indexing into detent 39. Outwardly projecting bumpers 42 are molded on whistle device 30 to protect the sharp edge 36 around the orifice 32 from being damaged. Rib 44, molded into the main body of toy 10, similarly protects the lower end of orifice 32 from damage.

The orifice 32 is located in a plane which is tangent to a cylinder formed around the axis of rotation of the toy 10. Having the orifice portion project into the airstream creates turbulence which improves the relative air flow past the orifice and enhances the operation of the whistle device. The orifice is located at the periphery of the disk 10 to obtain maximum air flow past said orifice 32 as the toy moves through the air.

Figure 5:
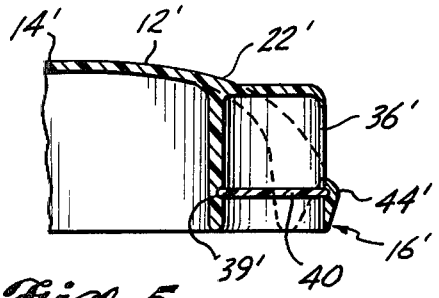
FIG. 5 is a view of the whistle device mounted on the toy 10.

A second embodiment of the whistle device mounted on the toy 10 is shown in FIG. 5. In this embodiment the whistle is molded as a part of the toy 10 and is completed to form the whistle chamber by inserting a flat disk 40 upwardly into the cylindrical opening formed during molding so that disc 40 snaps into detent 39'. In this simplified embodiment the whistle chamber is formed by a single molding step with aperture 36' formed by extension of the upper surface 22' and rim 16'. The toy 10 must be molded of a relatively flexible elastomer, as is well known in the molding arts so that mold embossments forming detent 39' can be withdrawn after molding without damage to the molded part.

In use, the toy 10 described herein is sailed through the air by techniques well known in the art. A user grasps the toy 10 in either hand and positions the fingers inside the interior of the toy 10 with the thumb positioned on the exterior of the toy 10. The toy 10 is thrown with a sweeping arm motion and a wrist-snap which give forward velocity and rotational spin. Air flows past the orifice 32 and excites the whistle chamber within the whistle device 30, producing an audible sound. This occurs whether the toy 10 is rotated in a clockwise or a counterclockwise direction about its axis of rotation. The direction of rotation is determined by a user releasing the toy 10 either from the right hand or from the left hand. The velocity of air past the orifice 32 of a whistle device is produced by both the forward translation and by the rotation of the toy 10. At certain points of rotation, the translational and rotational air velocities past the orifice reinforce each other to produce a higher relative velocity and an enhanced whistle or chirping sound. For each whistle device this produces a chirp having a period corresponding to the angular velocity of the toy 10. Different whistle sounds are obtained by varying the dimensions of the whistle device and multiple pitch sounds can be obtained by use of whistle devices producing differing sound frequencies.

Figure 4:
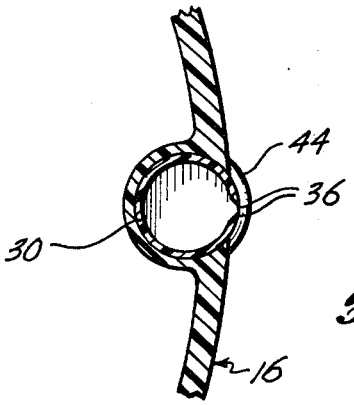
FIG. 4 is a partially fragmented plan view of a portion of a flying toy according to the invention taken along section line 4—4 of FIG. 2.

The whistle device 30 may be integrally formed with the toy 10, as shown in the embodiment of FIG. 5 or as in the embodiment of FIGS. 2 and 3. It is formed as a separate piece snap-fit inserted into appropriate recesses 38 formed in the periphery of toy 10. The toy 10 may be molded with a protective bumper 44 thereon to protect the sharp edge 36 around the orifice 32 from being damaged as is shown in FIG. 4.

While a particular embodiment of the present invention has been shown and described, it should be understood that the invention is not limited thereto since many modifications may be made. It is therefore contemplated to cover by the present application any and all such modifications that fall within the true spirit and scope of the basic underlying principals disclosed and claimed herein.

I claim:

1. A saucer shaped flying toy to be sailed through the air and rotated about an axis of rotation, comprising:

a circular central disk having an upper surface;

a depending rim positioned concentrically about the central disk and having an outer surface;

a curved transition portion positioned between the central disk and the rim, said transition portion having a convex upper surface which provides a smooth transition between the upper surface of the central disk and the outer surface of the rim;

a pneumatically-operated bi-directional whistle device projecting about said convex upper surface and having a whistle chamber comprising a substantially cylindrical-shaped hollow body having an axis aligned substantially parallel to said axis of rotation and having an elongated slot orifice located in the side of said hollow body in a plane which is tangent to a cylinder formed around said axis of rotation at the periphery of said toy, said hollow body extending outwardly from the toy into the air, said orifice having a sharp edge bordering the perimeter thereof and being aligned so that, when the toy is rotated in either direction about its axis of rotation, the whistle device is intermittently operated; and protective bumper means located adjacent said elongated slot orifice protecting said orifice from damage.

2. The toy of claim 1 including a plurality of whistle devices symmetrically located about the axis of rotation.

3. The toy of claim 2 wherein said plurality of whistle devices are positioned symmetrically about the periphery of said toy.

4. The toy of claim 2 wherein said plurality of whistle devices include at least two whistle devices generating sounds at different frequencies.

* * * * *